US006638036B1

(12) United States Patent
Kobayashi et al.

(10) Patent No.: US 6,638,036 B1
(45) Date of Patent: Oct. 28, 2003

(54) METHOD OF MANUFACTURING VENTILATING DEVICE AND THE VENTILATING DEVICE

(75) Inventors: Kenji Kobayashi, Yamaguchi (JP); Tomoyuki Shibuya, Yamaguchi (JP); Koji Okada, Chiba (JP); Takaaki Matsubara, Yamaguchi (JP); Haruo Hirakawa, Yamaguchi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/869,046

(22) PCT Filed: Jan. 12, 2000

(86) PCT No.: PCT/JP00/00099

§ 371 (c)(1),
(2), (4) Date: Jun. 22, 2001

(87) PCT Pub. No.: WO00/42325

PCT Pub. Date: Jul. 20, 2000

(30) Foreign Application Priority Data

Jan. 12, 1999 (JP) ..... 11/4937

(51) Int. Cl.[7] ..... F04B 17/00; F04B 35/04

(52) U.S. Cl. ..... 417/423.1; 454/83

(58) Field of Search ..... 417/423.1, 423.5, 417/423.14, 423.15; 415/182.1, 213.1, 214.1, 215.1, 220, 224; 454/83, 103, 104, 105, 112

(56) References Cited

U.S. PATENT DOCUMENTS

| | | | | |
|---|---|---|---|---|
| 2,710,573 A | | 6/1955 | Marker | 98/43 |
| 3,688,867 A | | 9/1972 | Antonetti et al. | 181/33 K |
| 4,672,819 A | * | 6/1987 | Mino et al. | 63/298 |
| 5,137,490 A | * | 8/1992 | Ishikawa et al. | 454/75 |
| 5,263,894 A | * | 11/1993 | Hirakawa et al. | 454/105 |
| 5,403,163 A | * | 4/1995 | Murphy | 417/350 |
| 5,439,415 A | * | 8/1995 | Hirikawa et al. | 454/70 |

FOREIGN PATENT DOCUMENTS

| | | |
|---|---|---|
| DE | 29 520020 | 2/1996 |
| JP | 47-41040 | * 12/1972 |
| JP | 1-36039 | * 11/1989 |
| JP | 3 096422 | 4/1991 |
| JP | 5-77726 | 3/1993 |
| JP | 05-077726 | * 3/1993 |
| JP | 5-178207 | 7/1993 |
| JP | 5-254428 | 10/1993 |
| JP | 10-281097 | * 10/1998 |
| TW | 197988 | 3/1992 |

* cited by examiner

*Primary Examiner*—Charles G. Freay
*Assistant Examiner*—Han L Liu
(74) *Attorney, Agent, or Firm*—Antonelli, Terry, Stout & Kraus, LLP

(57) ABSTRACT

A ventilating device capable of being easily assembled and disassembled, wherein, after setting a blower for exhaust and a blower for air supply on an electric motor (55), the electric motor is installed in an exhaust flow path (122) of a silencer box (100). The inside of the silencer box (100) is divided by partitions into the exhaust flow paths (122, 123) and air supply flow paths (132, 134) and sound absorbing material is installed on the wall surfaces of the air flow paths (122, 123, 132 and 134). Each blower aligns with each of the air flow paths when an air blow device is inserted, and an opening into which the air blow device is inserted is covered by a cover (150). The blowers can be assembled and disassembled from the side and the air blow devices can be inserted from the upper side.

31 Claims, 21 Drawing Sheets

METHOD OF MANUFACTURING VENTILATING DEVICE AND THE VENTILATING DEVICE

FIELD OF THE INVENTION

This invention relates to a ventilating device for high-speed rolling stocks.

PRIOR ART

The high-speed rolling stocks, represented by Shinkansen, are airtight structures, so that ventilating devices for permuting the air inside the car and the air outside the car are mounted at a predetermined rate. The ventilating device has the capability of ventilating while maintaining the pressure variation inside the car within a predetermined range, against the compression wave (positive pressure) during passing of tunnels, and the expansion wave (negative pressure).

This ventilating device is, as is disclosed in Gazette of Japanese Patent No. 2,685,521, provided with an exhaust fan and an air supply fan at both ends of an electric motor with its rotary shaft provided horizontally. Also, in order to cool the electric motor, the electric motor is covered by a case, and the exhaust air from the passenger car reaches the exhaust fan via the case.

SUMMARY OF THE INVENTION

Generally, the ventilating device has its case for cooling the electric motor fixed to the end brackets of the electric motor. This makes the assembly operation of the ventilating device difficult.

Moreover, in order to maintain the predetermined capability of the ventilating device, it is necessary to remove (clean) the dust collected at the impellers of the blowers periodically, and to exchange the bearings of the electric motors. That is, disassembly operation for maintenance operation of the ventilating device becomes necessary. In this case, because the above-mentioned case is fixed to the end brackets of the electric motor, the disassembly operation was troublesome.

The object of the present invention is to simplify assembly operation and disassembly operation.

The above-mentioned object is accomplished by constituting a ventilating device from:

- a ventilating blower installed inside an air flow path inside a box, including an electric motor with an rotary shaft provided in a horizontal direction;
- an opening provided to a surface in a vertical direction or in a horizontal direction of the box, for inserting the ventilating blower;
- a plate for covering the opening; and
- at least two openings for ventilation provided to a structure comprising the box and the lid.

The "two in number" of the openings in above-mentioned "two openings" is the case of equipping one above-mentioned ventilating blower in one above-mentioned box. The ventilating blower in this case is either a blower for exhaust or a blower for air supply. When two air flow paths, that is, a blower for air supply and a blower for exhaust are equipped in one box, the number of the openings becomes four.

Also, there are cases when this opening is provided to above-mentioned plate, and an opening (covered by a plate) for inserting the ventilating blower could be used for at least one of the openings.

DETAILED DESCRIPTION OF PREFERRED EMBODIMENTS

Figure 1:
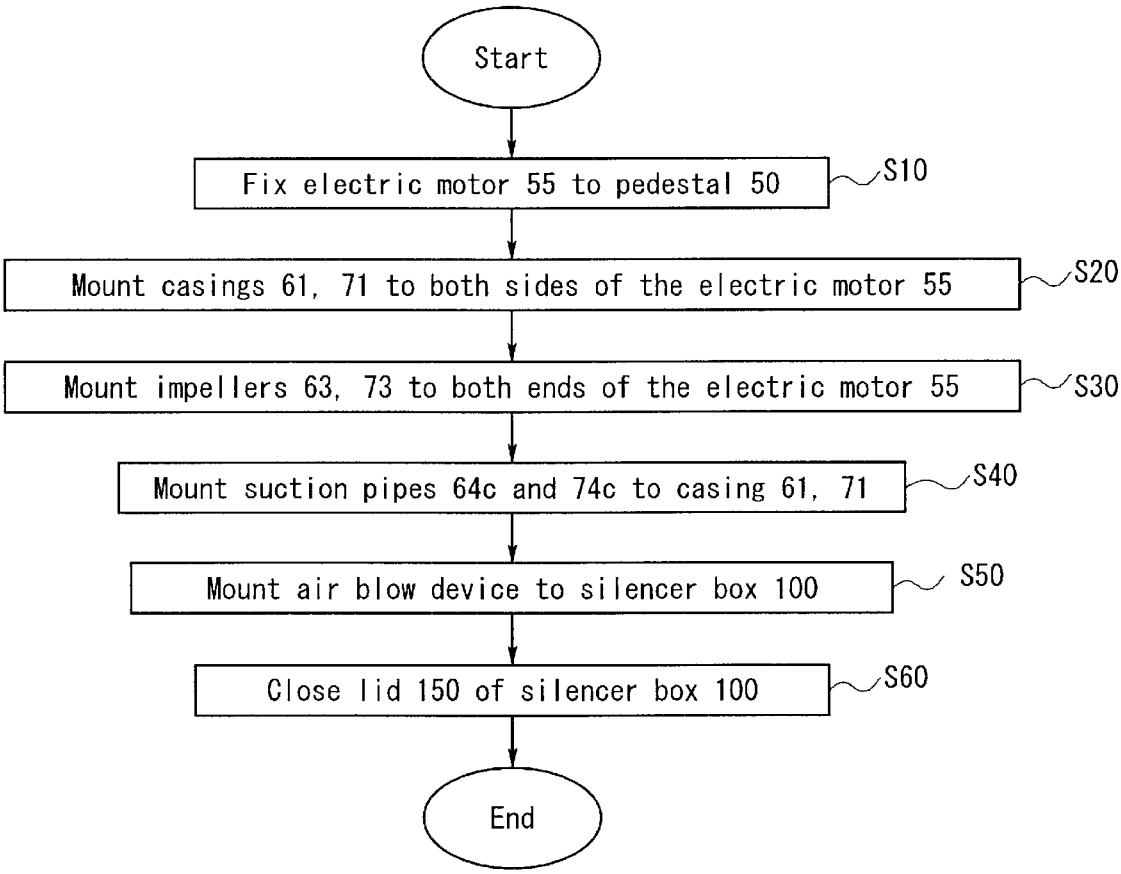
FIG. 1 is a flowchart indicating the manufacturing process of a ventilating device according to one example of the present invention.
Figure 2:
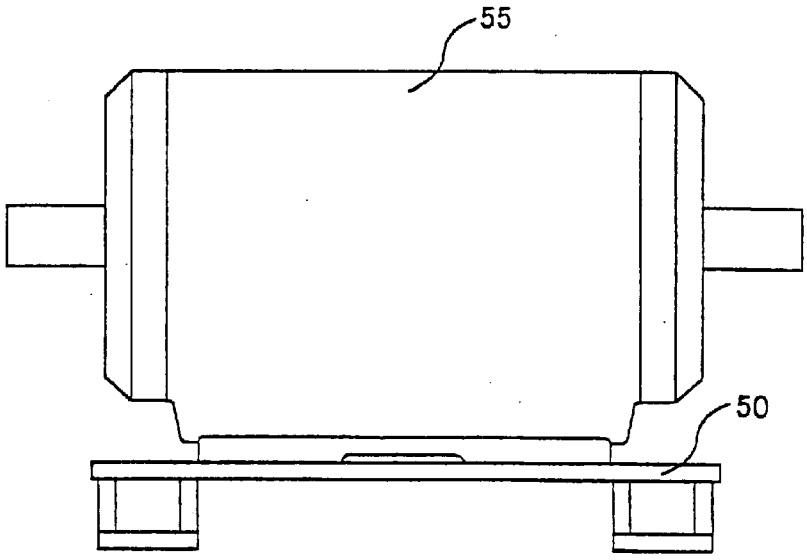
FIG. 2 is a front view of an electric motor rested on a pedestal.
Figure 3:
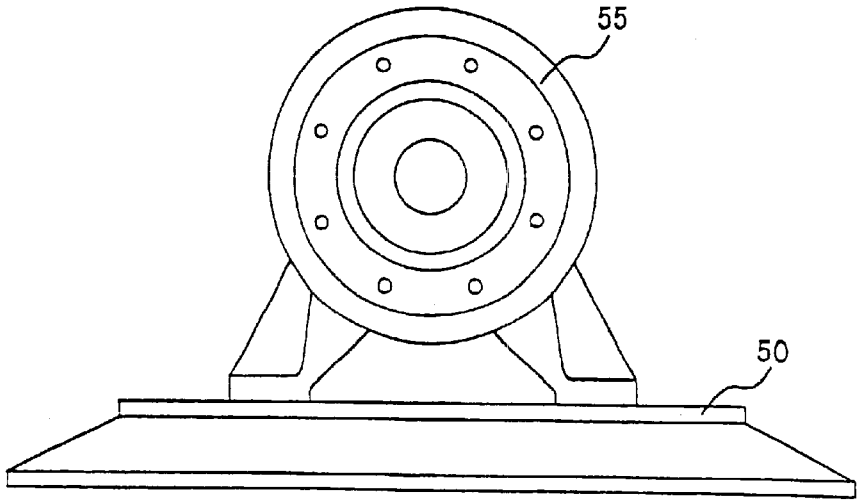
FIG. 3 is a right side view of FIG. 2.
Figure 4:
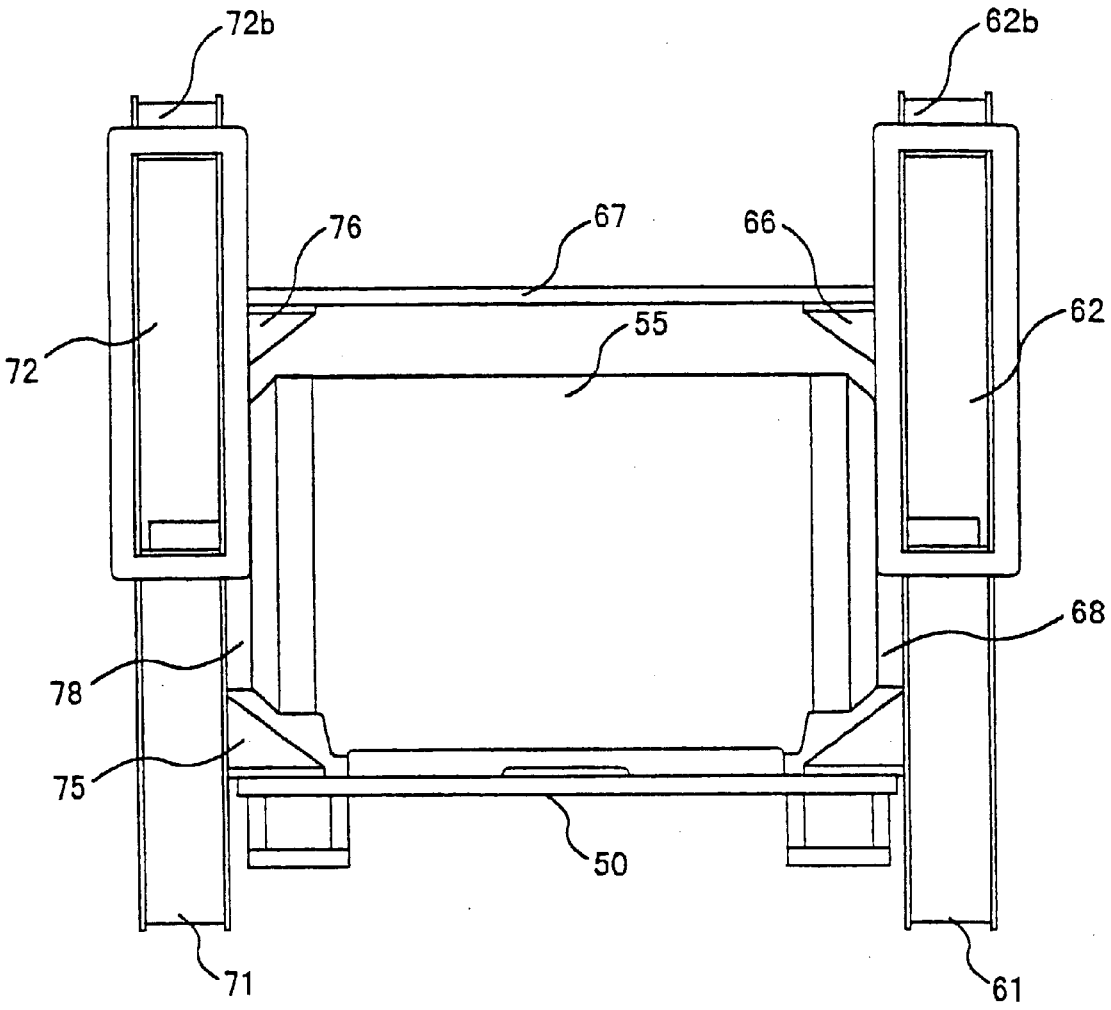
FIG. 4 is a front view of the electric motor in FIG. 2 installed with casings for blowers.
Figure 5:
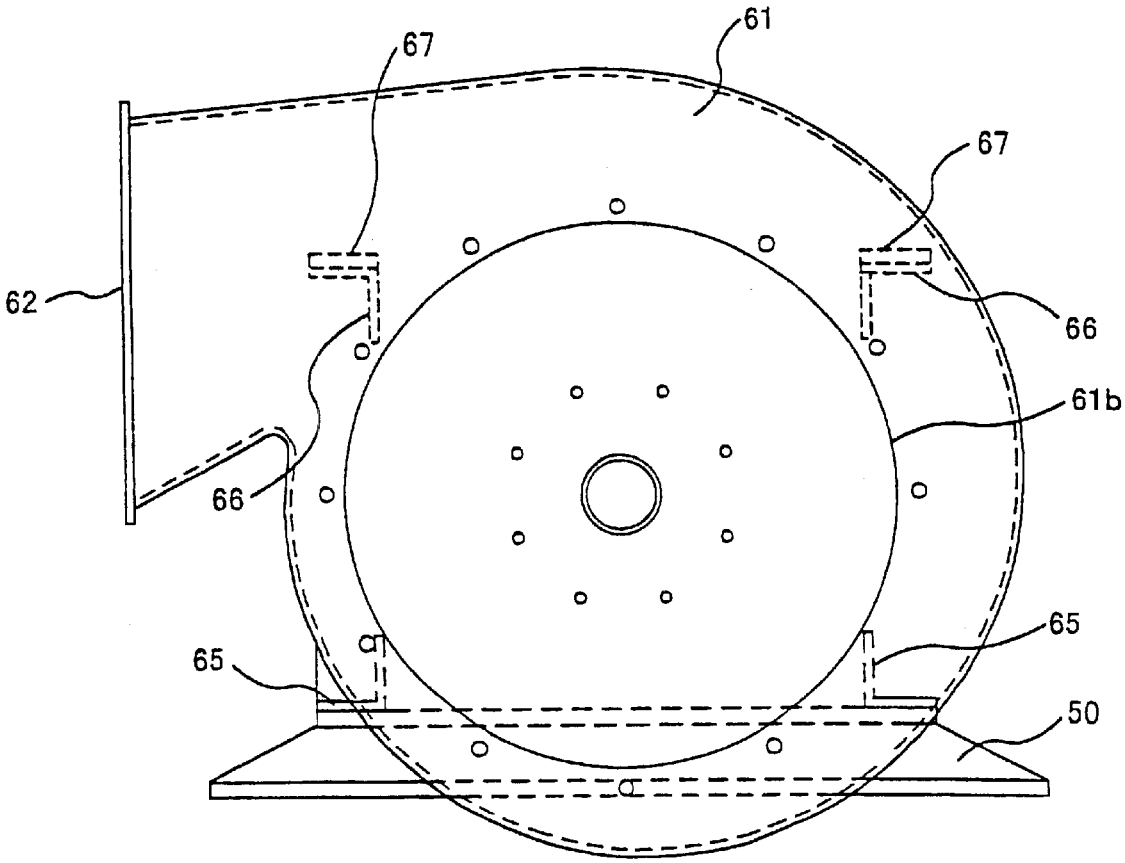
FIG. 5 is a right side view of FIG. 4.
Figure 6:
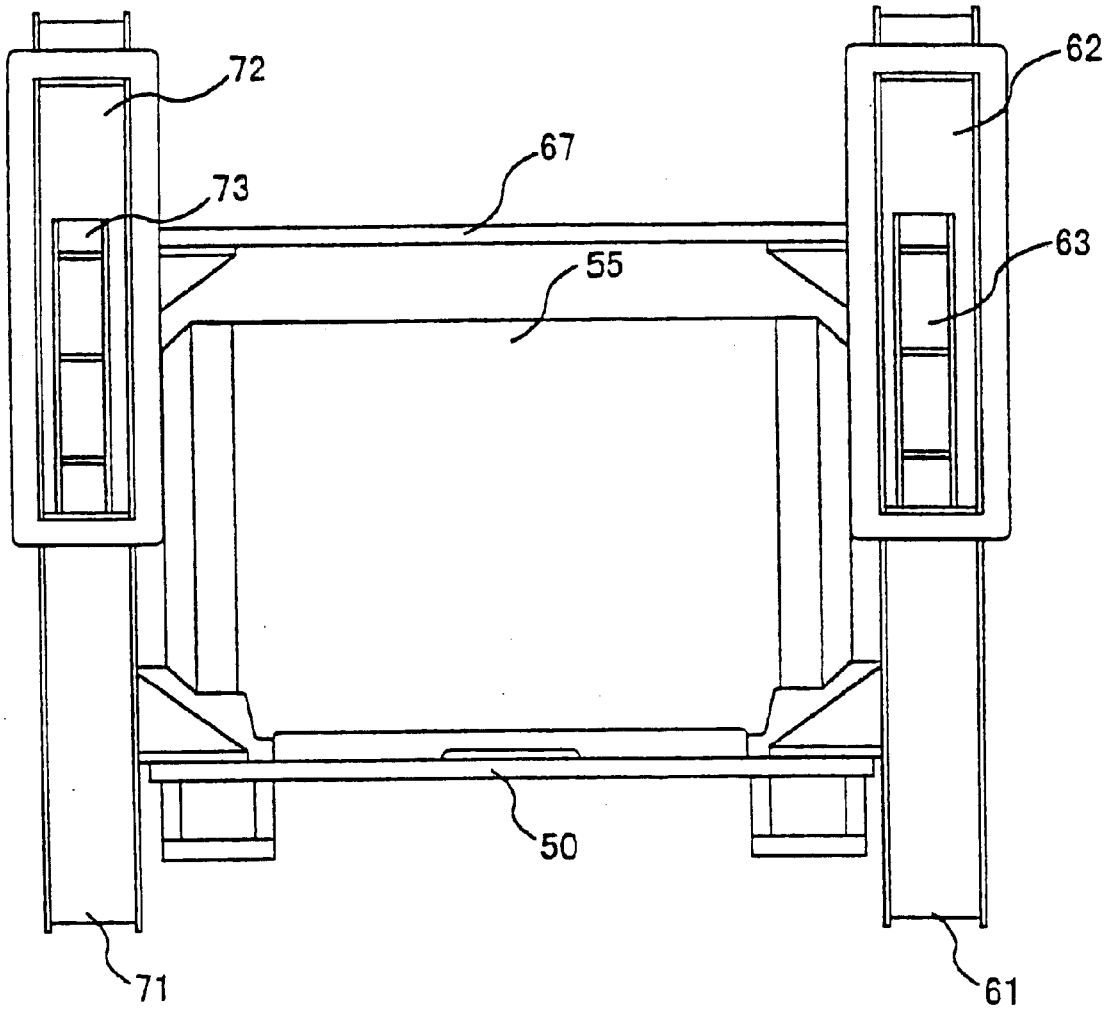
FIG. 6 is a front view of the blower in FIG. 4 installed with impellers.
Figure 7:
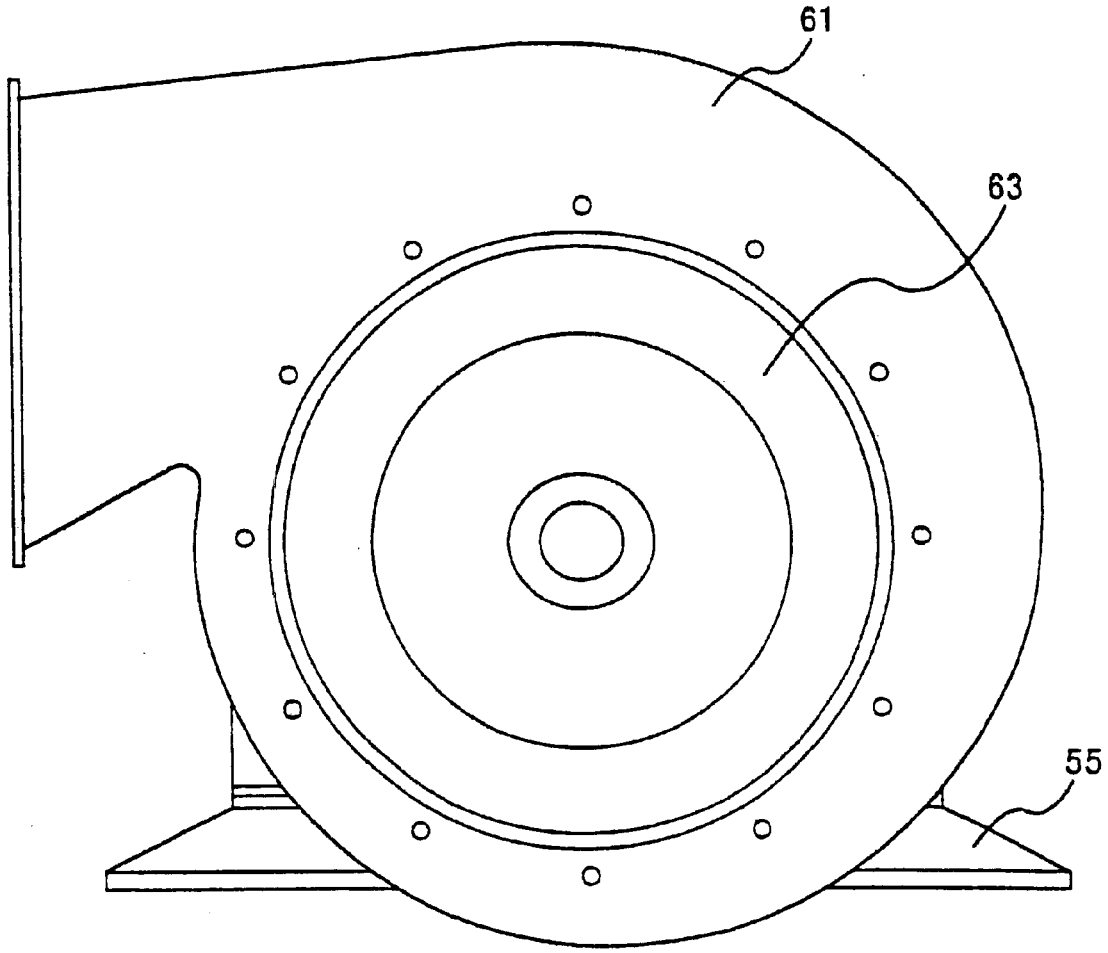
FIG. 7 is a right side view of FIG. 6.
Figure 8:
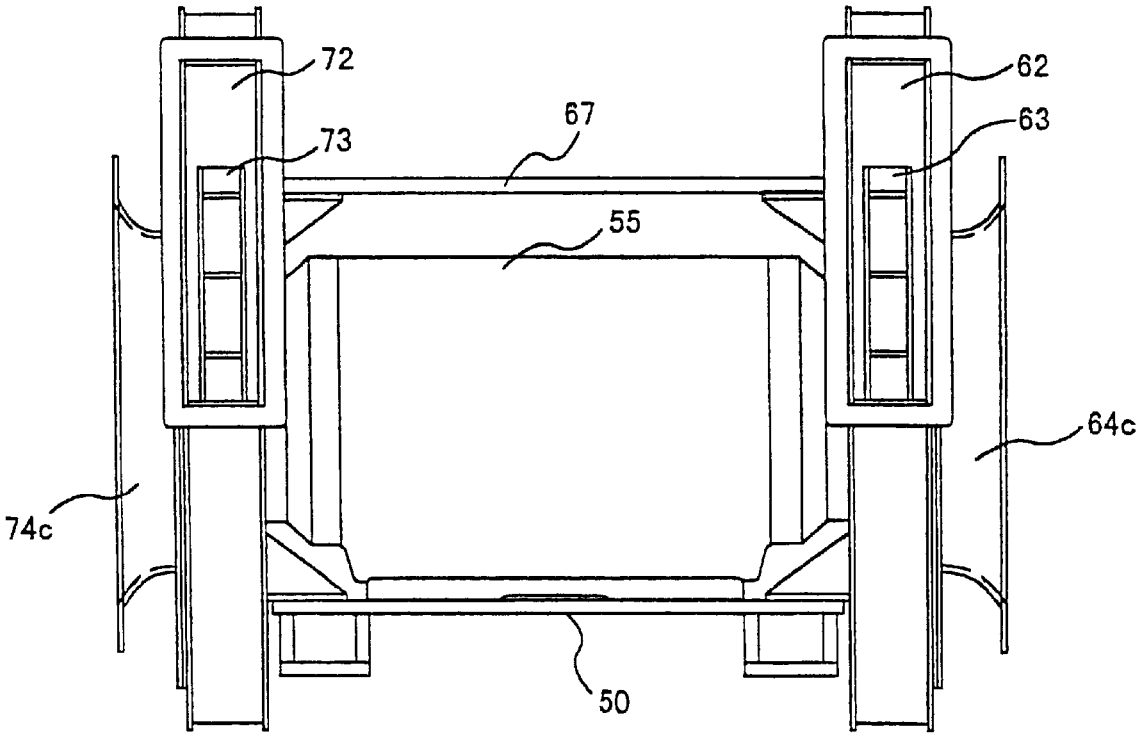
FIG. 8 is a front view of the blower in FIG. 6 installed with suction pipes.
Figure 9:
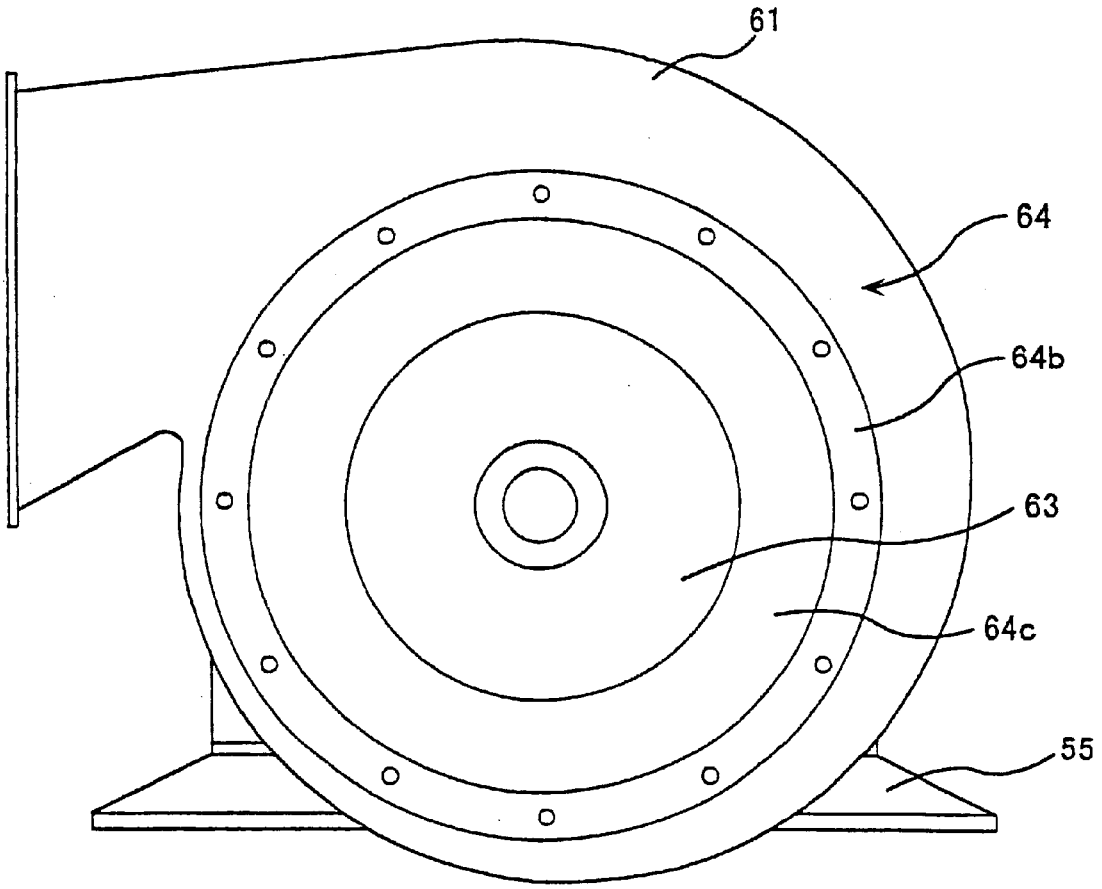
FIG. 9 is a right side view of FIG. 8.

An example according to the present invention will now be described hereinafter with reference to FIG. 1 through FIG. 24. First, the outline of the manufacturing process of the ventilating device will be described with reference to FIG. 1

An electric motor 55 is fixed to a pedestal 50 (step S10).

An exhaust casing 61 and an air supply casing 71 of a blower are mounted to both sides of the electric motor 55 fixed to the pedestal 50 (step S20).

Impellers 63, 73 are respectively mounted to both shaft ends of the electric motor 55 (step S30).

A suction pipe for exhaust 64*c* and a suction pipe for air supply 74*c* are respectively mounted to the exhaust casing 61 and the air supply casing 71 (step S40).

The unit manufactured in the process of the above-mentioned step S10 through step S40 is called an air blow device.

The above-mentioned air blow device is mounted to the interior of a silencer box 100 with built-in air supply flow path and exhaust flow path. The air blow device is electrically wired. Also, the opening through which the air blow device was inserted is closed by a lid 150. After carrying out other final operations, the process is completed (step S50).

Next, the structures of various parts for the above-mentioned manufacturing steps will be described.

Step S10: The electric motor 55 of the both shaft type is attached onto the pedestal 50 by screws, in FIG. 2 and FIG. 3. The shaft of the electric motor 55 is provided in the horizontal direction. The pedestal 50 is constituted by combining a flat plate and channel materials. When seen from above, the end portions of the pedestal 50 project further than the electric motor 55. With such configuration, the pedestal 50 could be inserted into the silencer box 100 and then attached thereto with screws from above. The pedestal 50 includes screw holes or nuts, and the electric motor includes holes for passing the screws through. The attaching portions of the screws mentioned later have screw holes on one of the members, and holes on the other.

Step S20: The casing 61 for blower for exhaust, and the air supply casing 71 are respectively installed to both ends of the electric motor 55, in FIG. 4 and FIG. 5. The blower is a multiblade fan.

First, the lower portions of the casings 61, 71 of the blower are fixed to the pedestal 50. In casings 61, 71, there exist brackets 65, 66, 75, 76 to the plate on the side of the electric motor 55. The brackets 65, 75 are attached to the upper surface of the pedestal 50 by screws from above.

Next, the casings 61, 71 are attached to end brackets of the electric motor 55 with screws via cushionings 68, 78. The plates of casings 61, 71 on the side of the electric motor 55 are attached. This attachment is performed through an opening 61*b* (opening 71*b* is not shown) for inserting impeller of the casings 61, 71. Air outlets 62, 72 of the casings 61, 71 are equipped with flanges 62*b*, 72*b* projecting abroad. The flange 72*b* is especially necessary.

Next, the upper brackets 66, 76 of the casings 61, 71 are connected together from above by a rigid connecting member 67. The connection is performed by attaching with screws from above.

Step S30: The impellers 63, 73 are mounted to both shaft ends of the electric motor 55, in FIG. 6 and FIG. 7. The mounting is performed from the opening 61*b* on the suction hole side of the casings 61, 71. The opening 61*b* is larger than the outer diameter of the impellers 71, 72.

Step S40: Members 64, 74 for the suction holes are mounted to the plates on the suction hole side of the casings 61, 71, in FIG. 8 and FIG. 9. To explain the member 64 of the suction hole, it is comprised of a flange 64*b* for covering the opening 61*b*, and a suction pipe 64*c*. Flange 64*b* is attached to the casing 61 with screws. The suction pipe 64*c* is expanded at the suction side. The same applies to member 74.

Step S50: It will be explained with reference to FIG. 10 through FIG. 24. The unit obtained in step S40 will be called the air blow device. This air blow device is inserted through the opening at the upper surface of the silencer box 100, and is fixed thereto. Also, the electric motor 55 is performed with wiring operation, and the opening is covered by the lid 150. Also, the connection of the exhaust duct unit 180 is conducted.

Figure 10:
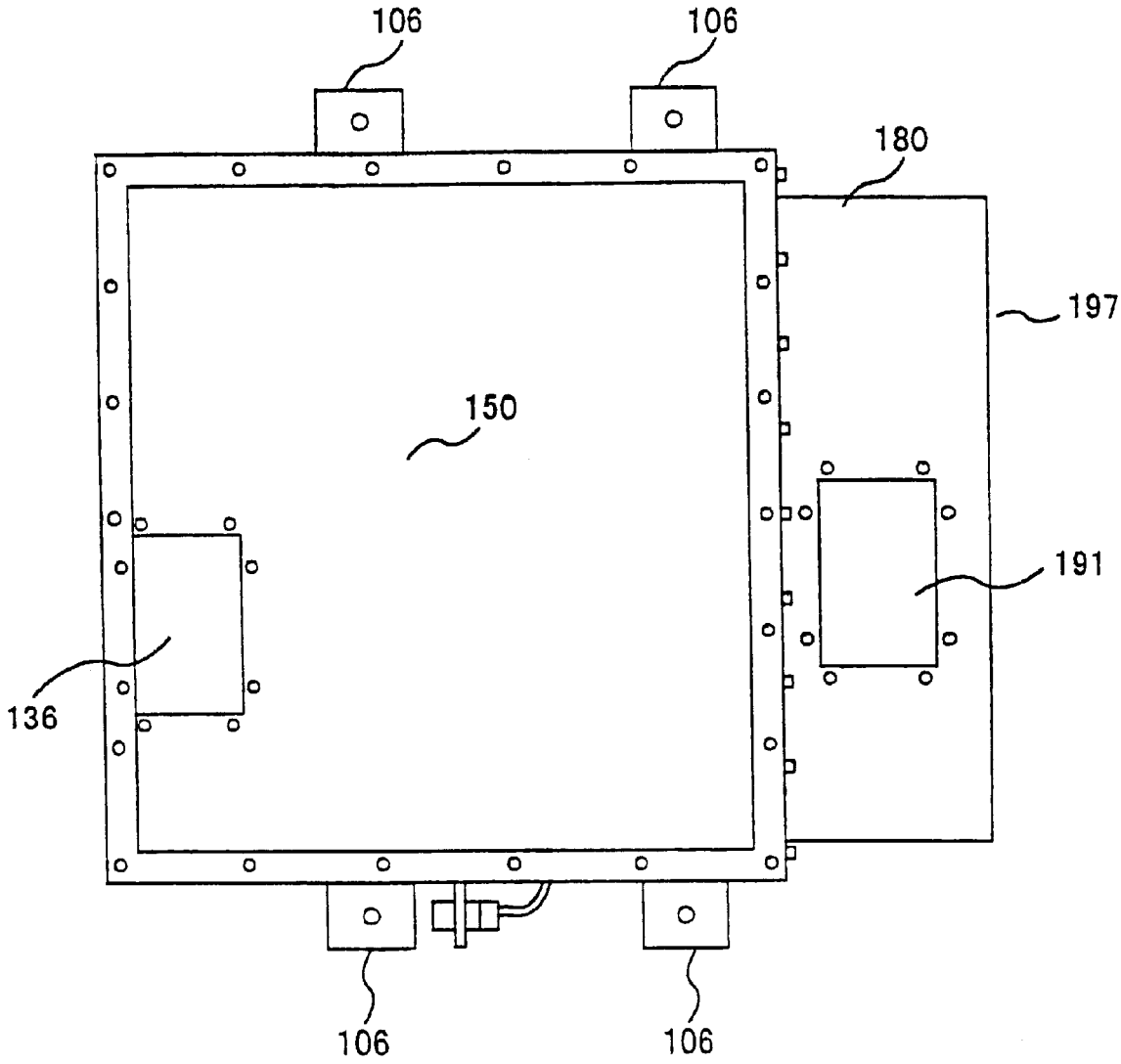
FIG. 10 is a plane view of the ventilating device according to one example of the present invention.

In FIG. 10, the ventilating device is comprised of the silencer box 100 with the air blow device stored therein, and the exhaust duct unit 180. An outlet 136 for air supply flow path is provided at the upper surface of the silencer box 100. An inlet 131 for air supply flow path is provided at the rear surface of the silencer box 100. The exhaust duct unit 180 is fixed to the right side surface of the silencer box 100. An inlet 191 for exhaust flow path is provided at upper surface of the exhaust duct unit 150. The openings 136, 191 are connected to a passenger car of the car body through the ducts. Screw holes for connecting with the duct at the car body side are provided to peripheries of the openings 136, 191. An outlet 196 for exhaust flow path is provided at the right side surface of the exhaust duct unit 180. Reference number 106 denotes a pedestal for suspending from the car body.

In FIG. 11 through FIG. 22, the silencer box 100 is comprised of a silencer box and a lid 150. The lid 150 closes the upper surface of the silencer box 100. The lid 150 is attached to the upper portion of the silencer box 100 with screws.

The silencer box 100 is a square box made of metal. The silencer box includes a bottom, but is opened at the upper surface thereof. The exhaust flow path and the air supply flow path are constituted by partitioning the box with partitions. The silencer box 100 is provided with inlets 121, 131 and outlets 126, 136 for respective air flow paths. The inlet 121 and the outlet 126 of the exhaust flow path are opened at the plate of the right side surface of the silencer box 100. The inlet 131 of the air supply flow path is opened at the rear surface, and the outlet 136 is opened at the upper surface, that is, at the lid 150. The upper surface of the lid 150 is a plate made of metal. The left side of the silencer box 100 is the air supply flow path, and the right side thereof is the exhaust flow path.

The exhaust flow path is comprised of a flow path 122 running from the front surface side of the silencer box 100 to the rear surface side, and a flow path 123 running along the rear surface. The air from the blower for exhaust is ejected to the front surface side. The flow path 122 and the flow path 123 are partitioned by a partition 115. The opening from the flow path 122 to the flow path 123 is provided to the lower portion of the silencer box 110. The flow path 123 is connected to the outlet 126.

The exhaust flow path and the air supply flow path are parted to left and right by the partition 110. The partition 110 extends from the vicinity of the front surface side to the plate of the rear surface. The partition 110 is provided with an opening 133 for the entrance to the blower for air supply. Partitions 116, 117 are provided between the front surface side of the partition 110 and the plate of the front surface. The plate 116 is provided with an opening opposing the outlet 72 of the blower for air supply. The partition 117 partitions the inner portion of the front surface side to left and right. The air supply flow path is partitioned to a flow path 132 of the inlet side and a flow path 134 of the outlet side with a partition 119.

The wall surfaces constituting the exhaust flow path and the air supply flow path, that is, the inner surface of the plates of the silencer box 100, the partitions 110, 115, 116, 117, 119 and the like, and the inner surface of the plates of the lid 150, are affixed with sound absorbing materials 108 to constitute the silencer. The corner portions of the air flow paths are formed in arcuate shape. The outer surface of the sound absorbing material is suitably covered with punching metals.

The silencer box 100 is provided with a bottom, and a pedestal 105 for resting the pedestal 50 is provided to the upper surface of the bottom plate. The lower portion of the electric motor 55 is installed with the sound absorbing material 108*c*. The casings 61, 71 are positioned to both sides of the pedestal 105.

The lid 150 is rested on a depressed flange at the upper surface of the silencer box 100, and is attached thereto from above with screws.

The assembly process will be described. First, the air blow device obtained in S40 is inserted into the silencer box 100 without the lid 150, and is rested on the pedestal 105. The end portions of a base 50 are attached to the pedestal 105 from above with screws. The air blow device has its rotary shaft positioned in left and right directions. The outlets 62, 72 of the respective blowers are facing the front surface side. It is preferable to rest the air blow device through a vibration-proof rubber. Next, a wire 107 is connected to a terminal base of the electric motor 55. The wire 107 is pierced through the silencer box 100 in advance.

When the air blow device is inserted to the silencer box 100, the leading ends of the suction pipes 64*c*, 74*c* engage with the partitions 111, 112 provided with semicircular recessed portions. The partition 111 is installed at the inner surface of the plate at the right side surface of the silencer box (blower side). The partition 112 is installed at the partition 110.

The partition 112 is positioned more toward the blower side than the partition 110.

To describe the partition 111, the cross-section of the semicircular recessed portion includes a U-shaped groove. The groove is arranged with cross-sectionally U-shaped cushioning 113. The leading end of the suction pipe 64*c* comes into contact with the cushioning 113. The partition 111 above the semicircular recessed portion is expanded in a trapezoid shape. A cross-sectionally U-shaped cushioning 113*b* is arranged to the trapezoid portion. The same applies to the partition 112.

Next, the lid 150 is attached to the silencer box 100 from above with screws. The lower surface of the lid 150 is arranged with the sound absorbing materials opposing the flow paths 122, 123, 132, 134 and the like. To the areas opposing the partitions 110, 115, 116, 117 and the like, the cusionings are arranged in order to prevent air leakage.

Partitions 161, 162 for closing the openings of the partitions 111, 112 are suspended from the lower surface of the lid 150. To describe the partition 161, the lower end of the partition 161 is formed in a semicircular recessed portion coming into contact with the semicircular portion of the upper portion of the suction pipe 64*c*. The recessed portion is provided with a U-shaped groove. The groove is arranged with a U-shaped cushioning 113. The leading end of the suction pipe 64*c* comes into contact with the cushioning 113. Also, both sides of the recessed semicircular portion 121*b* are expanded in trapezoid shape in conformity with the partition 111. The trapezoid portion comes into contact with the cushioning 113*b*. The same applies to the partition 162.

The position in the silencer box 100 where the air blow device is inserted is in the exhaust flow path 122. The electric motor 55, the blower for exhaust, and the blower for air supply are all positioned in the exhaust flow path 120. The outlet 62 of the blower for exhaust is positioned in the exhaust flow path 122.

The flange 72*b* of the opening 72 of the blower for air supply comes into contact with the partition 116 partitioning the exhaust flow path 120 and the air supply flow path 130. The cushioning is arranged between the two. To make sure that the flange 72*b* comes into contact with the partition 116, the air blow device is forced against the front surface side of the silencer box 100, and the base 50 is attached to the pedestal 105.

Next, the exhaust duct unit 180 is fixed to the plate at the right side surface of the silencer box 100 with screws.

Figure 11:
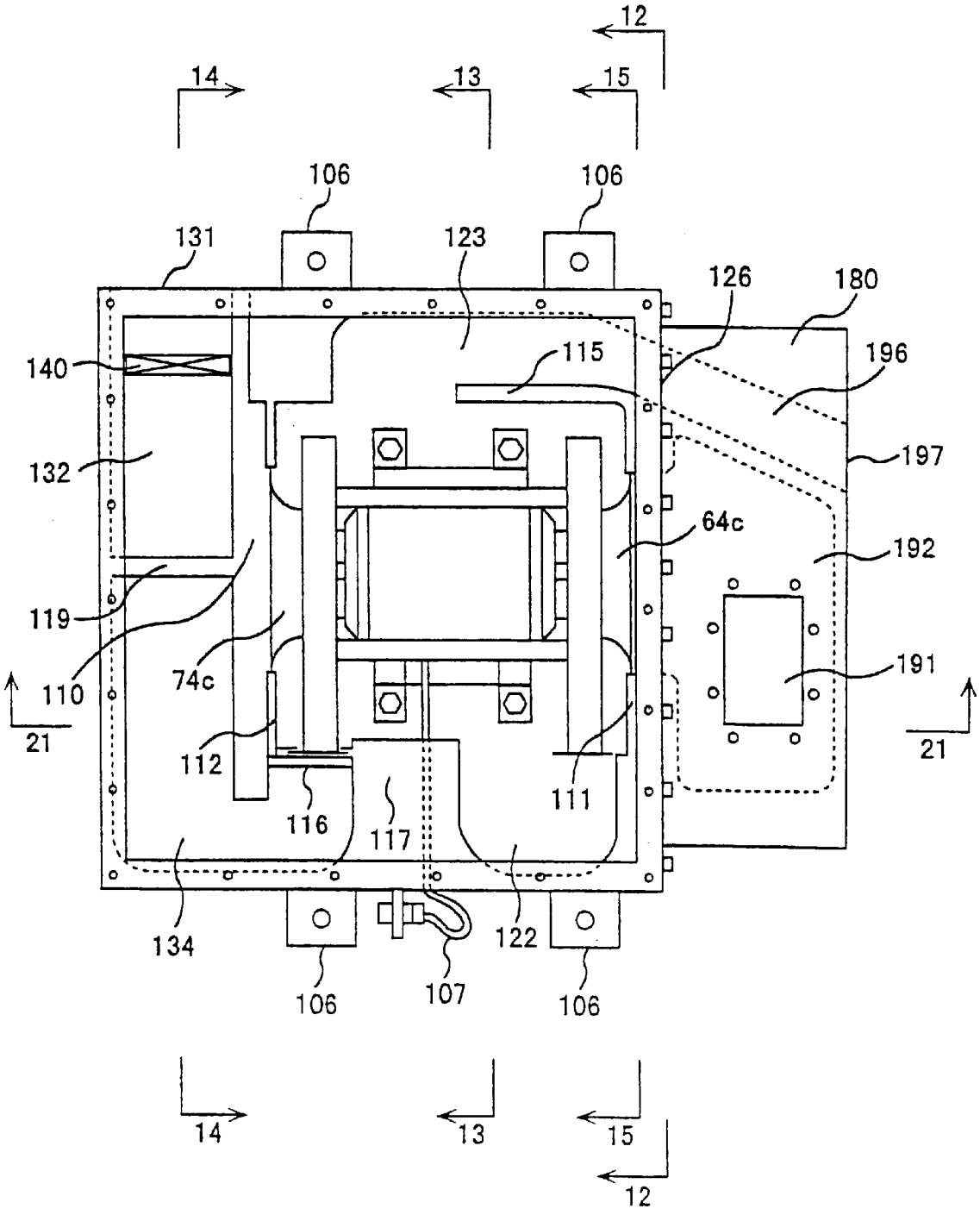
FIG. 11 is a plane view of the ventilating device in FIG. 10 with lid taken off.
Figure 12:
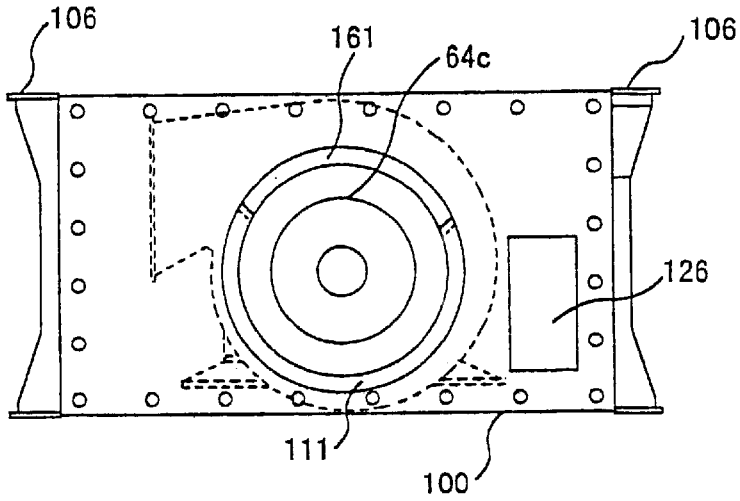
FIG. 12 is a cross-sectional view taken along line 12—12 in FIG. 11.
Figure 13:
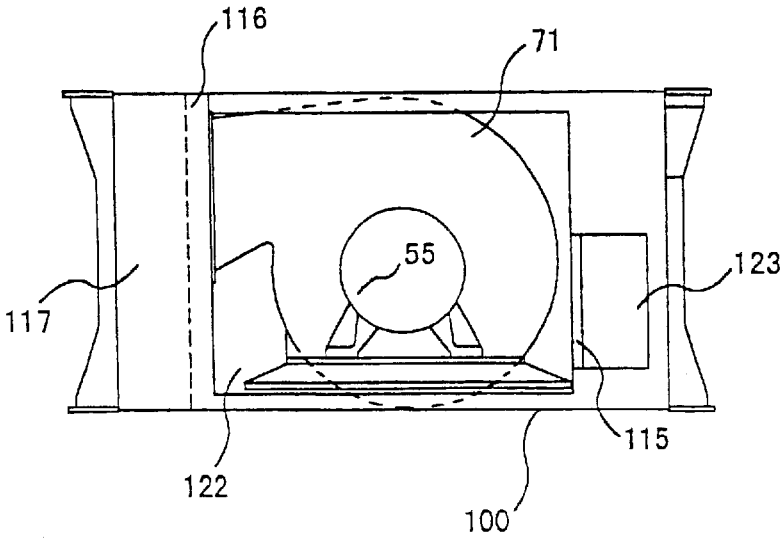
FIG. 13 is a cross-sectional view taken along line 13–13 in FIG. 11.
Figure 14:
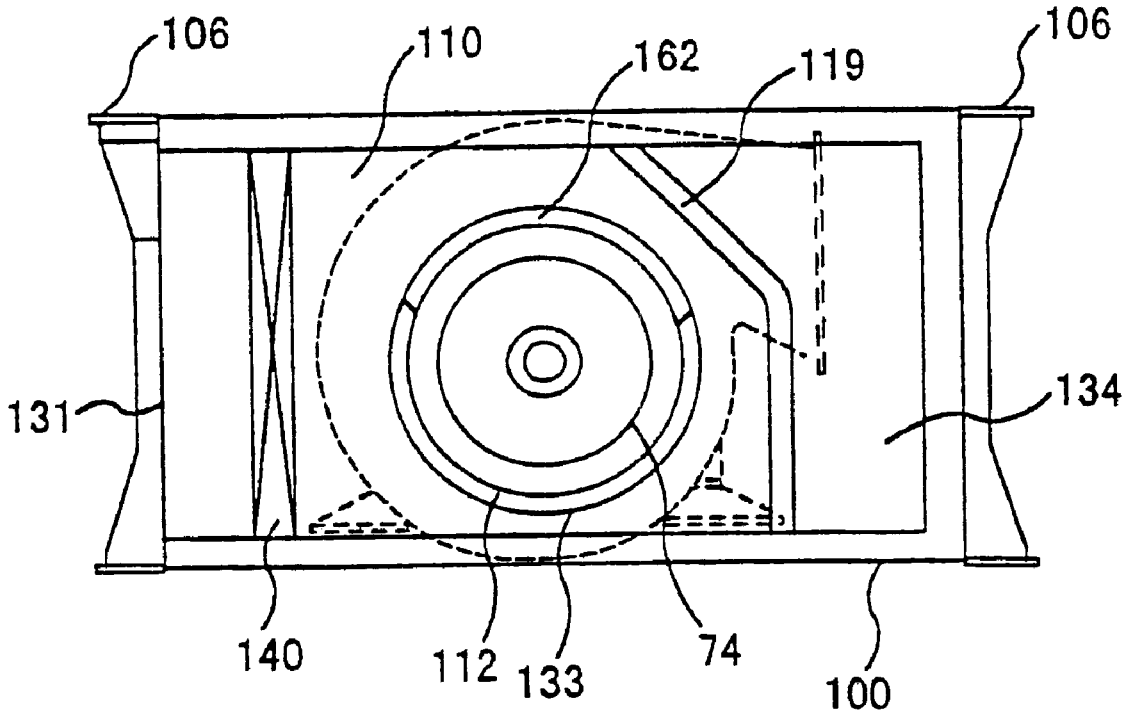
FIG. 14 is a cross-sectional view taken along line 14—14 in FIG. 11.
Figure 15:
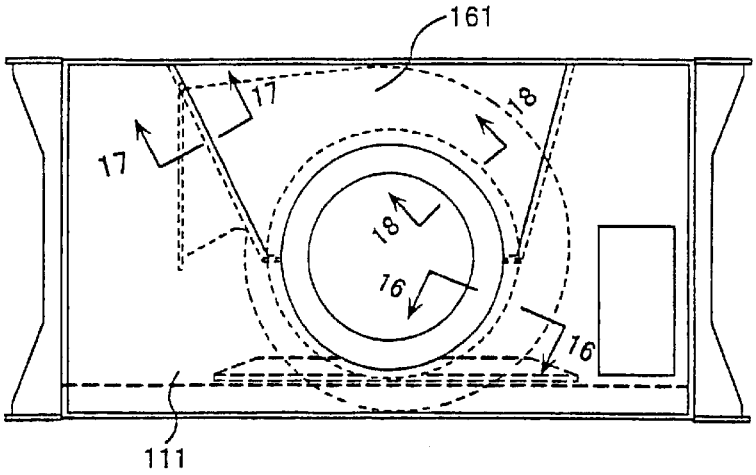
FIG. 15 is a cross-sectional view taken along line 15—15 in FIG. 11.
Figure 16:
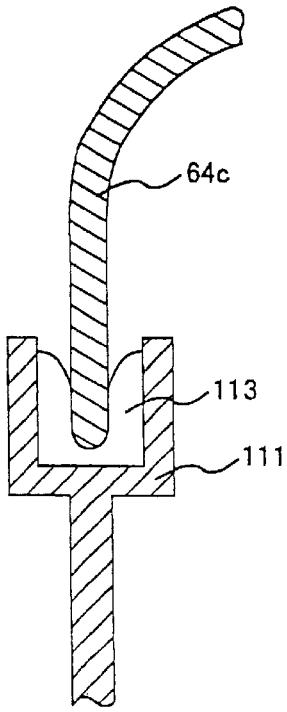
FIG. 16 is a cross-sectional view taken along line 16—16 in FIG. 15.
Figure 17:
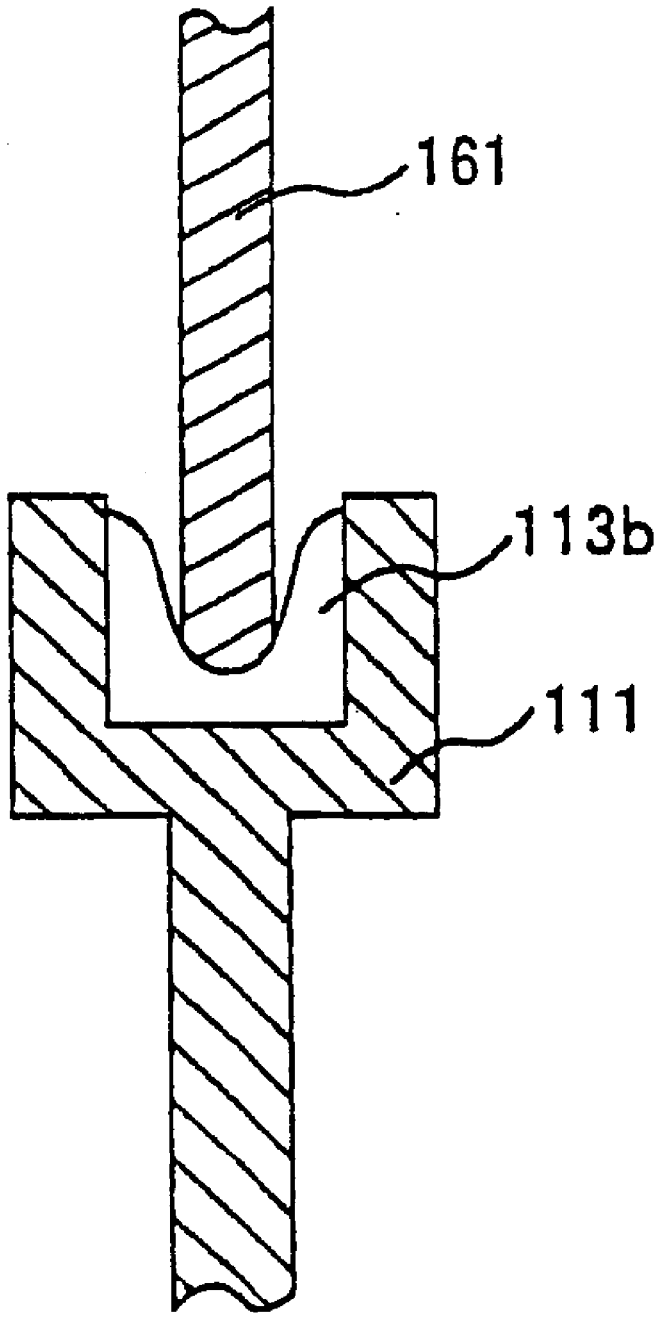
FIG. 17 is a cross-sectional view taken along line 17—17 in FIG. 15.
Figure 18:
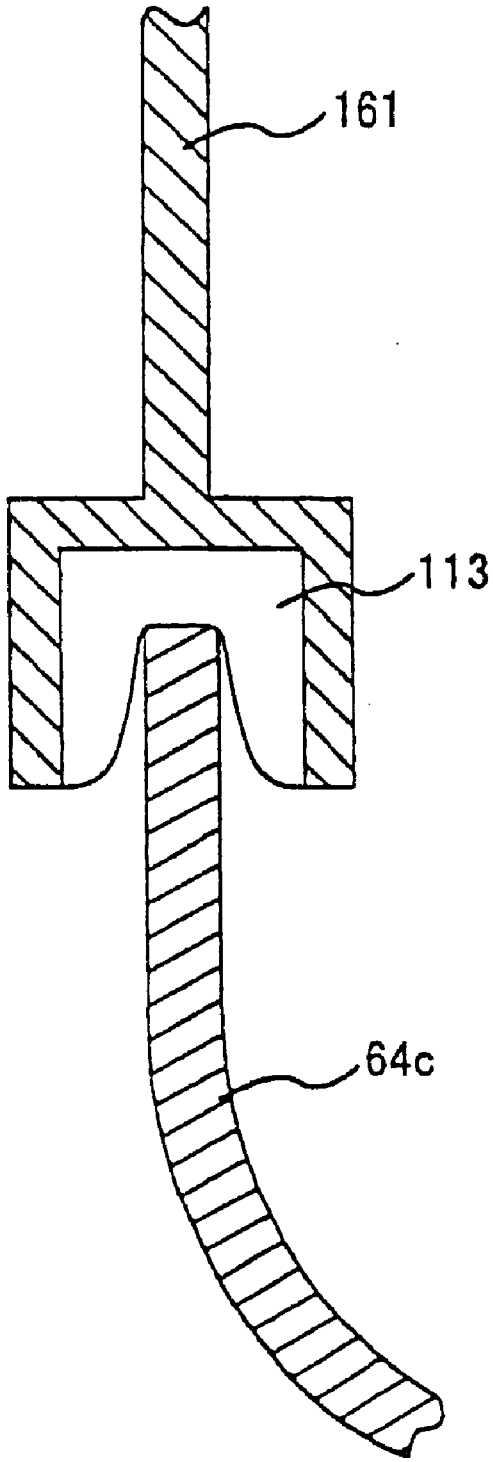
FIG. 18 is a cross-sectional view taken along line 18—18 in FIG. 15.
Figure 19:
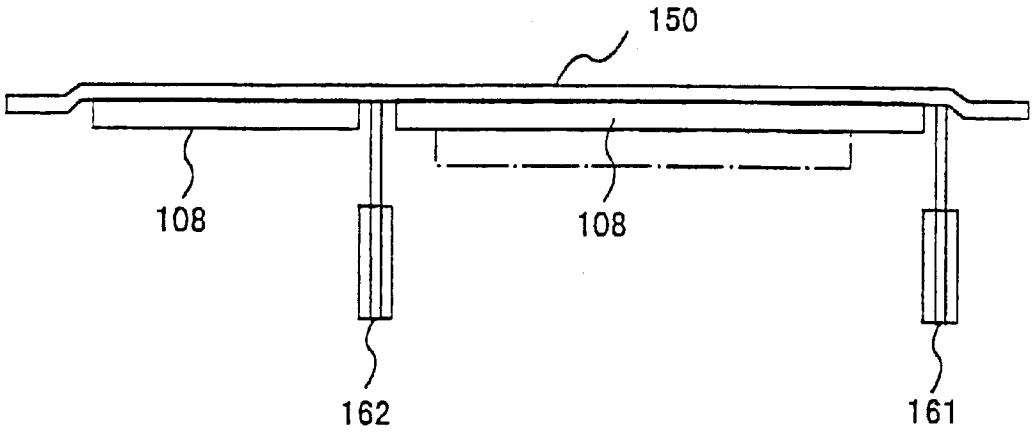
FIG. 19 is a longitudinal cross-sectional view of the lid in FIG. 10.
Figure 20:
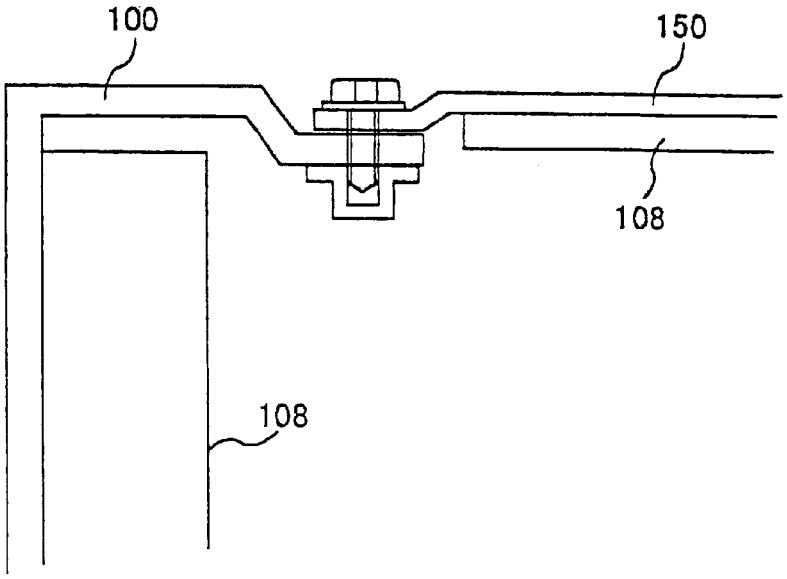
FIG. 20 is a cross-sectional view of the joint region of the silencer box and the lid in FIG. 10.
Figure 21:
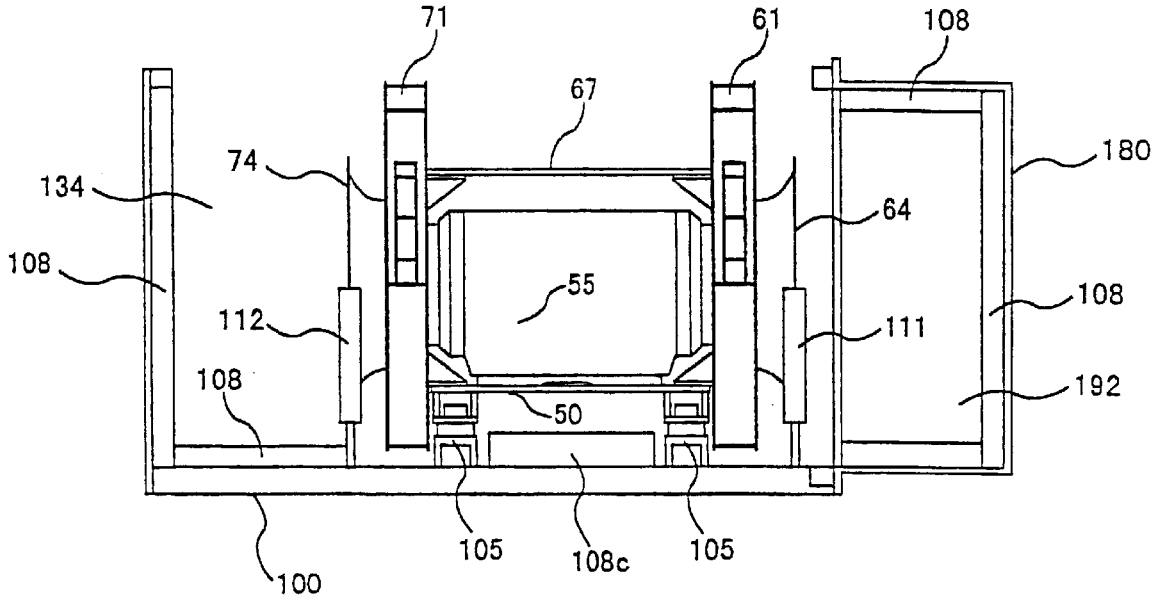
FIG. 21 is a cross-sectional view taken along line 21—21 in FIG. 11.
Figure 22:
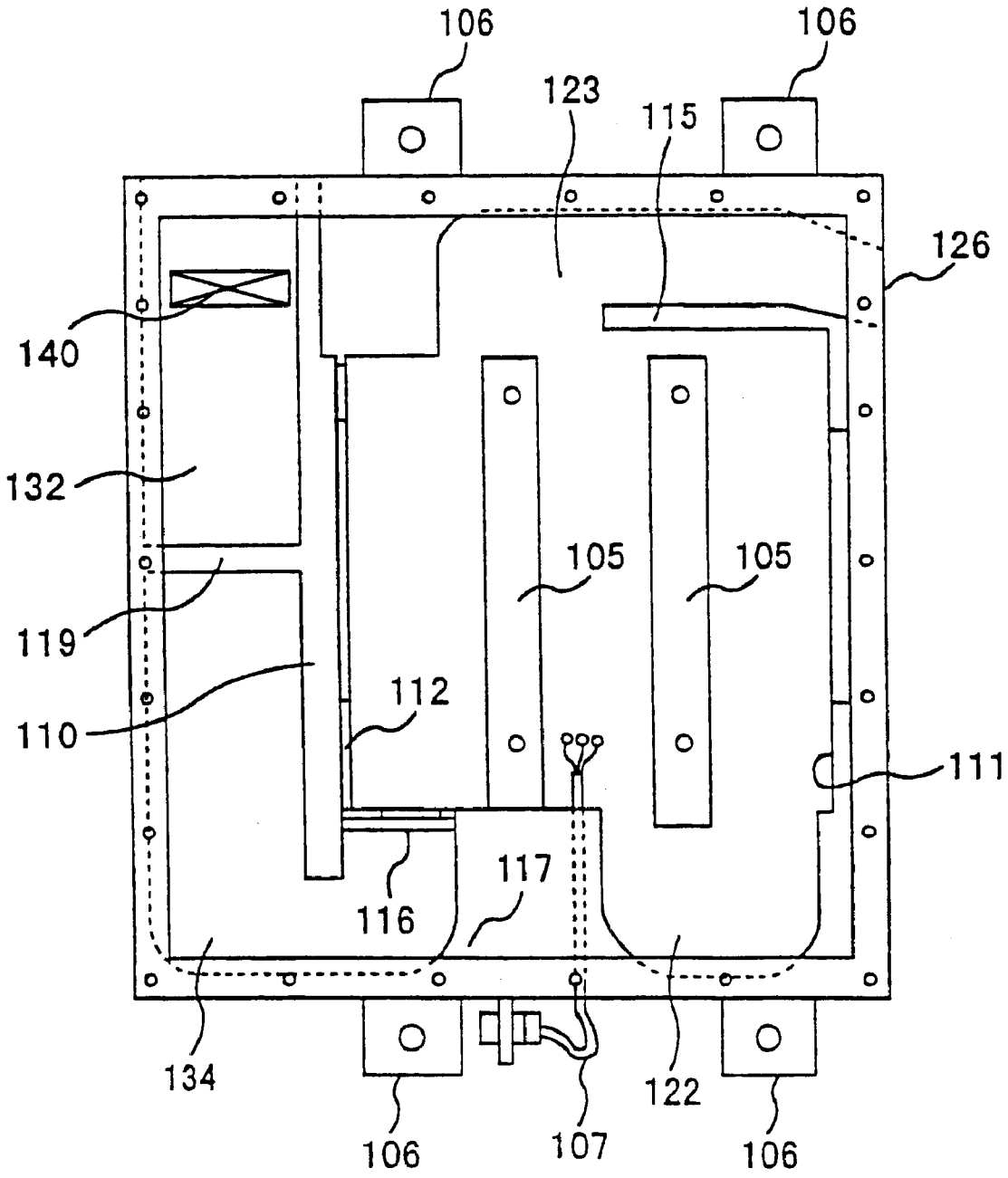
FIG. 22 is a plane view of the silencer box.
Figure 23:
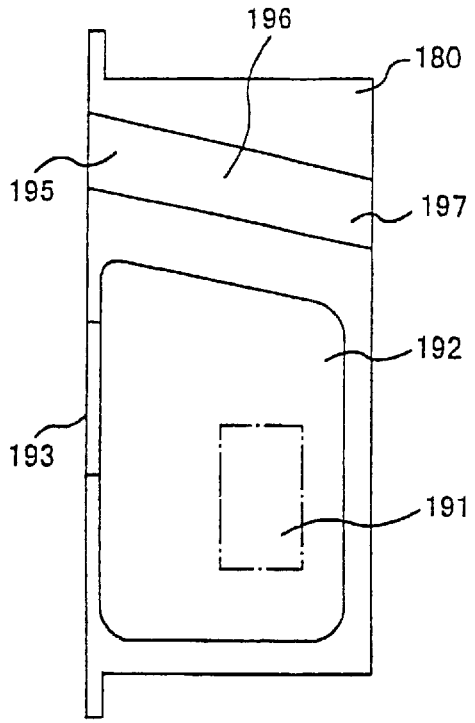
FIG. 23 is a horizontal cross-sectional view of the exhaust duct unit in FIG. 10.
Figure 24:
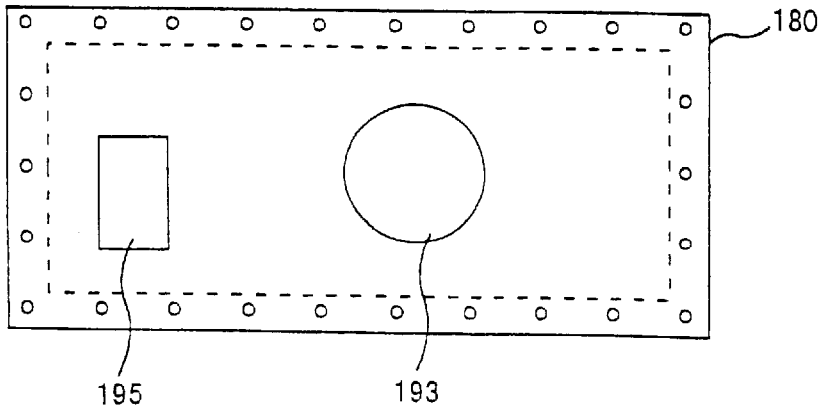
FIG. 24 is a left side view of FIG. 23.

In FIG. 11, FIG. 23 and FIG. 24, the exhaust duct unit 180 is a square box, with six sides thereof covered with plates. A flange for mounting is provided to the outer periphery at the left end. The exhaust duct unit 180 includes a suction flow path 192 and an exhaust flow path 196. An inlet 191 of the suction flow path 192 is opened at the upper surface. An outlet 197 of the exhaust flow path 196 is opened at the right side surface. An outlet 193 of the suction flow path 192 and the inlet 195 of the exhaust flow path 196 are opened at the left side surface. The outlet 193 opposes the suction pipe 64*c* of the exhaust blower.

The outlet 193 comes into contact with partitions 111, 161 via cushionings. The inlet 195 of the exhaust flow path 196 opposes the outlet 123 of the exhaust flow path. The inlet 195 comes into contact with the plate of the right side surface of the silencer box via the cushioning. Therefore, the outlet 193 projects more towards the silencer box 100 side than the inlet 195.

The sound absorbing material is installed to the wall surfaces of the air flow paths 192, 196 of the exhaust duct unit 180. The sound absorbing materials are installed to the plates for six surfaces of the exhaust duct unit 180, and to the partition for partitioning the flow path 192 and the flow path 196. After arranging the sound absorbing material to the interior, the plate for one of the surfaces is fixed to constitute the exhaust duct unit 180.

The exhaust air from the inlet 191 reaches the blower for exhaust through the flow path 192 and the suction pipe 64*c*. The exhaust air is boosted at this point, and is discharged to the front surface side of the flow path 122. The electric motor 55 is placed in the flow path 122, so that the exhaust air cools the electric motor 55. Then, it is ejected to the exterior via the flow paths 123, 196.

The fresh air entering from the inlet 131 reaches the blower for air supply from the suction pipe 74*c* via a flow path resistor 140 and the flow path 132. The fresh air is boosted at this point, and is discharged to the front surface side of the flow path 134, and reaches the outlet 136 via the flow path 134. The flow path resistor 140 changes the opening rate of the air flow path. By changing the opening rate, the amount of air entering the car is determined, and the pressure inside the car is set at a predetermined amount. The setting of the opening rate is performed from the inlet 131.

With such structure, the assembly of the air blow device could all be performed from above or from the side. Also, it could be assembled by inserting the air blow device to the silencer box 100 from above. Therefore, the assembly could be performed with ease.

Also, the above-mentioned box is arranged with sound absorbing material to constitute a silencer, therefore noise could be reduced.

Moreover, disassembling for the purpose of maintenance operation could be performed by removing the ventilating device from the car body, and then removing the lid 150 and pulling out the air blow device upwardly.

Next, after placing the air blow device horizontally, the members 64, 74 of the suction holes are removed, and the cleaning of the impellers 63, 73 are carried out. This cleaning could be performed by removing the impellers 63, 73 from the shaft. Also, the exchange of the bearings could be performed by removing the casings 61, 71 from the end brackets of the electric motor 55, and then removing the end brackets.

As is seen from above, the maintenance operation could be carried out with ease, because there is no need to turn the heavy air blow device upside down.

The silencer box 100 contains two blowers for air supply and exhaust, therefore four openings must be present. However, this opening could serve both as the opening for inserting the air blow device. In the above-mentioned embodiment, the outlet 136 of the air supply flow path serves both as the opening for inserting the air blow device, and is provided at the lid 150. Also, the outlet 126 of the exhaust flow path could be installed at the lid 150. As is seen from above, the silencer box 100 should have four openings for air supply and exhaust as a result, and there is no need to have four openings in the box before being covered by the lid 150.

The blower rotates at high speed. Therefore, there is a fear that the casings of the blower might vibrate. By fixing the lower portions of the casings 61, 71 to the pedestal 50, and fixing the upper portions of the casings 61, 71 together with plurality of connecting members 67, rigidity could be improved, and vibration could be restrained.

It could also be constituted by providing an opening for inserting the air blow device to the inner side of the lid 150, and covering the opening with a second lid. The partitions 161, 162 are installed on the second lid. By doing so, it becomes easier to align the partitions 161, 162 with partitions 111, 112.

The relation between the outlet 72 of the blower for air supply and the partition 116 may be made the same as the relation between the suction pipe 64*c* (74*c*) and the partitions 111, 161 (112, 162).

Also, the flange 72*b* of the outlet 72 maybe formed slightly downwardly, and the partition 116 may be formed slightly upwardly, and the two may be connected via the cushioning.

Moreover, the partitions 112, 162 may not be necessary. The inlet 133 is opened on the partition 110. The flange of the suction hole of the suction tube 74*c* comes into contact with the partition 110 via the cushioning. This contact is performed by pushing the electric motor 55 towards the partition 110 side. Further, in the case with the structure where the flange 72*b* of the outlet 72 of the blower for exhaust contacts the partition 116, the electric motor 55 is pushed towards the left side and the front surface side.

The partitions 111, 161 may not be necessary. The inlet 121 is opened at the plate of the right side surface of the silencer box 100. The member of the outlet 193 of the exhaust duct unit 180 comes into contact with the flange of the suction pipe 64*c* via the cushioning. This contact is performed by fixing the exhaust duct unit 180 to the silencer box 100. When the outlet 193 is projected, the thickness of the cushioning may be thinned.

As is the case with the exhaust duct unit 180, the unit including the flow paths 132, 134 may be made in a different unit from the silencer box 100.

Figure 25:
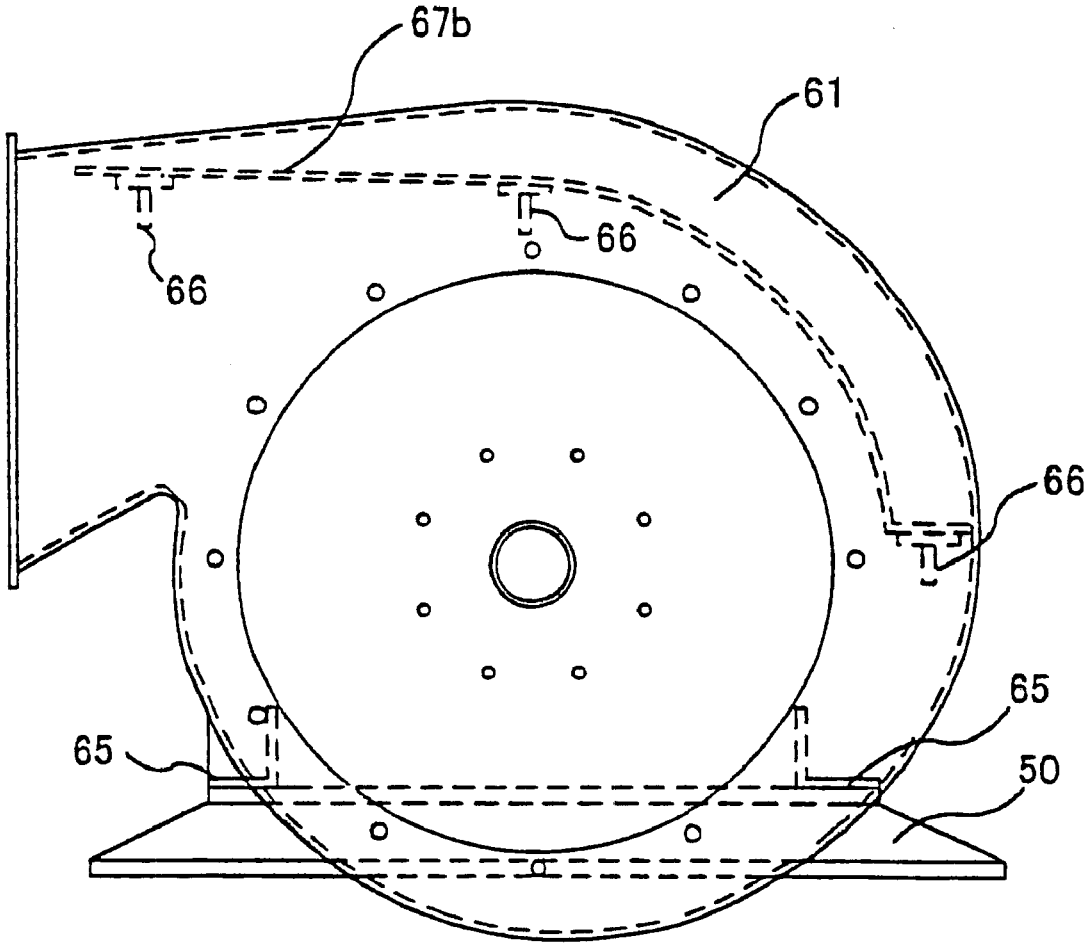
FIG. 25 is a right side view of another example of the blower.

The example according to FIG. 25 will be described. The electric motor 55 is provided inside the air flow path to keep cool. Therefore, it is preferable to form the connecting member 67*b* in an arcuate shape along the housing of the electric motor 55, so that the air flows along the electric motor 55. The sound absorbing material 108*b* (shown in FIG. 19) of the lid 150 is arranged adjacent to the upper surface of the front surface side of the connecting member 67*b*. With such arrangement, the amount of air flowing along the upper surface of the connecting member 67*b* could be made smaller, and the amount of air towards the electric motor 55 side could be made larger, enabling effective cooling. The width of the sound absorbing material 108*b* is about the length between the casings 61 and 71.

Air could be discharged directly from the silencer box 100 directly to the atmosphere, excluding the flow path 196 of the exhaust duct unit 180. Also, as the air supply flow path is provided inside the silencer box 100, the flow paths 192, 196 of the exhaust duct unit may be provided inside the silencer box 100.

The above-mentioned example is the case where a blower is provided respectively to both shaft ends of one electric motor. However, the same could be applied to the case of two electric motors, with one blower provided to each of the electric motors.

Equipment for controlling the electric motor 55, such as an inverter and the like, may be installed to the air flow path to cool. For example, it is installed to the lid 150.

Figure 26:
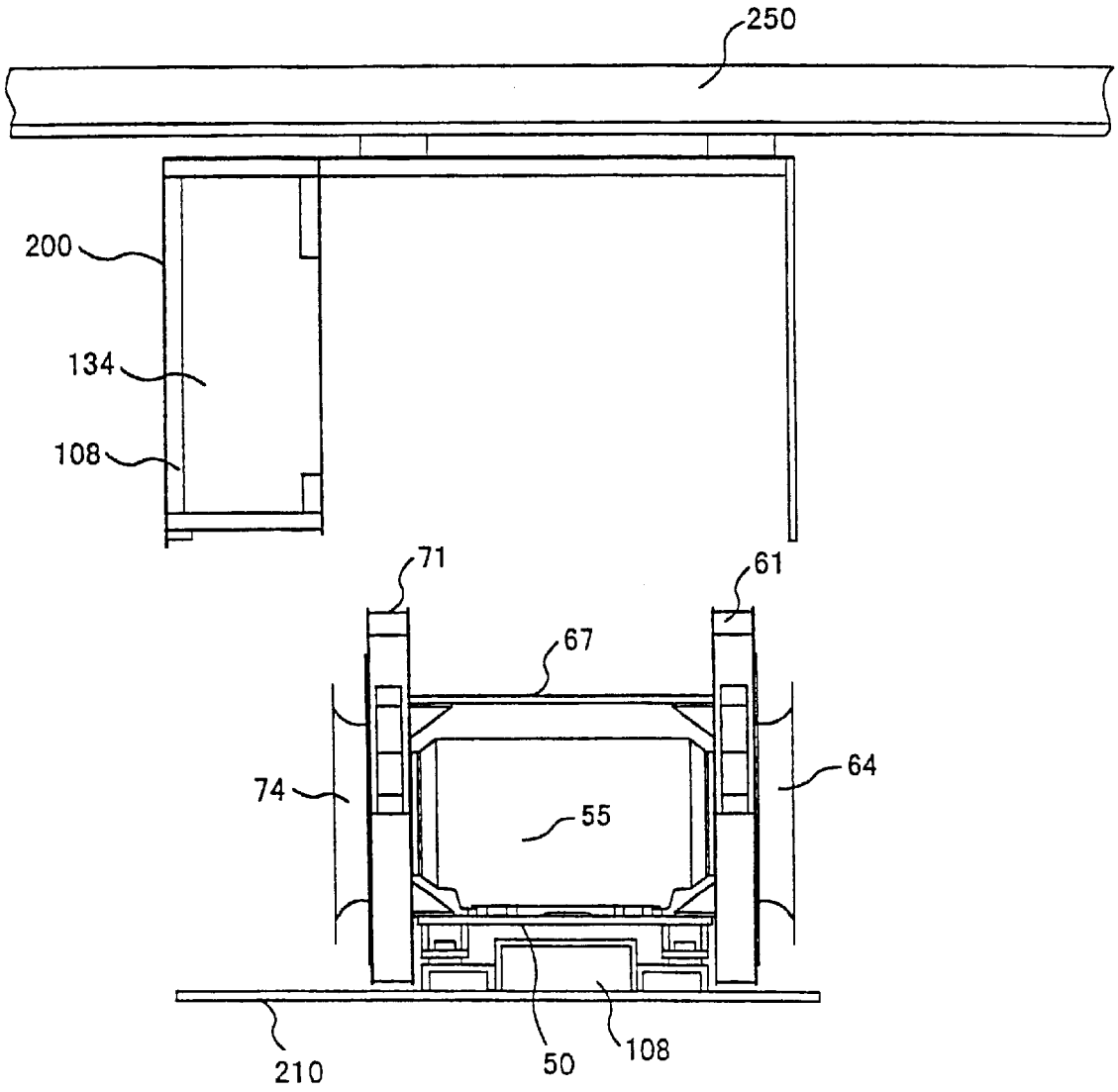
FIG. 26 is a longitudinal cross-sectional view of another example of the ventilating device of the present invention in disassembled condition.

The example according to FIG. 26 will be described. This is a longitudinal cross-sectional view of the condition where the air blow device is pulled out downwardly. This example is the case where the opening for inserting the air blow device is provided to the lower surface of the silencer box 200. The other structures are the same as the above-mentioned example, except that the exhaust duct unit 180 connected to the right side surface is not shown. In the case of a maintenance operation, the exhaust duct unit 180 is removed, and then the air blow device is pulled out downwardly. The silencer box 200 remains mounted to the car body 250.

The pedestal 50 of the air blow device is installed to the plate (lid) 210 for covering the opening at the lower surface of the silencer box 200. The plate 210 is constituted firmly. The plate 210 is fixed to the silencer box 200.

The air blow device is moved vertically in the above-mentioned example, but it may be stored by moving the same horizontally. When the direction of movement is in the direction of the shaft, the connection between the suction hole and the outlet of the blower could be made simple. In this case, it is preferable to face the outlet of the blower slightly towards the direction of movement. Also, it is preferable to construct so that the electric motor moves along a rail.

The above-mentioned example is a combination of two blowers in one electric motor and one silencer box. However, it may be formed in a combination of one blower and one silencer box. In this case, there should be two openings for ventilation to one silencer box as a result. In the case of inserting from the horizontal direction, the blower should be inserted by providing the outlet of the blower to face the direction of insertion (rear surface side), so that the outlet of the blower comes into contact with the partition.

The technical scope of the present invention is not limited to the terms used in the claims or in the summary of the present invention, but is extended to the range in which a person skilled in the art could easily substitute based on the present disclosure.

According to the present invention, the assembly operation and the disassembly operation could be performed with ease.

We claim:

1. A method of manufacturing a ventilating device, the method comprising:

inserting an air blow device including a blower for air supply to one end side of a rotary shaft of an electric motor of both shaft type, and an exhaust blower to another end side thereof, to an air flow path of a silencer box with the ability to include at least four openings as a result for ventilation, in a vertical direction;

fixing said air blow device to said silencer box with said rotary shaft provided in a horizontal direction; and covering said opening for insertion with a lid, wherein said air blow device is inserted in said box in a condition where said air blow device is rested on top of said lid.

2. A ventilating device, comprising:

a silencer box including an opening on one of the surfaces;

a lid being fixed to said box for closing said opening;

a structure comprising said box and said lid constituting at least first air flow path to its interior, the first air flow path having opposed upper and lower surfaces, and a second air flow path;

said structure including an inlet and an outlet for said first air flow path, and including an inlet and an outlet for said second air flow path;

an electric motor of both shaft type being fixed to the lower surface of said first air flow path inside said first air flow path, with a rotary shaft thereof provided in a horizontal direction;

a first blower for air supply or exhaust being installed to one end side of said electric motor, with a suction hole opened to one side surface of said silencer box, and an outlet opened inside said first air flow path; and a second blower for exhaust or air supply being installed to the other end side of said electric motor, with a suction hole opened to other side surface of said silencer box, and an outlet opened to a partition constituting said first air flow path;

wherein said lid is positioned to the lower surface of said silencer box; and said electric motor is rested on said lid.

3. A ventilating device, comprising:

a silencer box including an opening on one of the surfaces;

a lid being fixed to said box for closing said opening;

a structure comprising said box and said lid constituting at least first air flow path to its interior, the first air flow path having opposed upper and lower surfaces, and a second air flow path;

said structure including an inlet and an outlet for said first air flow path, and including an inlet and an outlet for said second air flow path;

an electric motor of both shaft type being fixed to the lower surface of said first air flow path inside said first air flow path, with a rotary shaft thereof provided in a horizontal direction;

a first blower for air supply or exhaust being installed to one end side of said electric motor, with a suction hole opened to one side surface of said silencer box, and an outlet opened inside said first air flow path; and a second blower for exhaust or air supply being installed to the other end side of said electric motor, with a suction hole opened to other side surface of said silencer box, and an outlet opened to a partition constituting said first air flow path;

wherein said lid is positioned to a side surface of said silencer box;

said electric motor is rested on a bottom surface of said silencer box; and said lid is in contact with a member of said suction hole of either said first blower or said second blower.

4. A ventilating device, comprising:

a silencer box including an opening on one of the surfaces;

a lid being fixed to said box for closing said opening;

a structure comprising said box and said lid constituting at least first air flow path to its interior, the first air flow path having opposed upper and lower surfaces, and a second air flow path;

said structure including an inlet and an outlet for said first air flow path, and including an inlet and an outlet for said second air flow path;

an electric motor of both shaft type being fixed to the lower surface of said first air flow path inside said first air flow path, with a rotary shaft thereof provided in a horizontal direction;

a first blower for air supply or exhaust being installed to one end side of said electric motor, with a suction hole opened to one side surface of said silencer box, and an outlet opened inside said first air flow path; and a second blower for exhaust or air supply being installed to the other end side of said electric motor, with a suction hole opened to other side surface of said silencer box, and an outlet opened to a partition constituting said first air flow path;

wherein casings of said first blower and said second blower are respectively fixed to end brackets of said electric motor;

each of said first blower and said second blower comprises impellers, and openings of said casings at said suction hole side are larger in diameter than that of said impellers of said blower; and each of said suction holes comprises a flange and a suction pipe, and said flanges are installed detachably to said casings.

5. A ventilating device according to claim 4, wherein said casing of said first blower and said casing of said second blower are connected by a rigid body.

6. A ventilating device according to claim 5, wherein each of said casings includes opposed upper and lower portions, and lower portions of said both casings are fixed to a pedestal for resting said electric motor.

7. A ventilating device, comprising:

a silencer box including an opening on one of the surfaces;

a lid being fixed to said box for closing said opening;

a structure comprising said box and said lid constituting at least first air flow path to its interior, the first air flow path having opposed upper and lower surfaces, and a second air flow path;

said structure including an inlet and an outlet for said first air flow path, and including an inlet and an outlet for said second air flow path;

an electric motor of both shaft type being fixed to the lower surface of said first air flow path inside said first air flow path, with a rotary shaft thereof provided in a horizontal direction;

a first blower for air supply or exhaust being installed to one end side of said electric motor, with a suction hole opened to one side surface of said silencer box, and an outlet opened inside said first air flow path; and a second blower for exhaust or air supply being installed to the other end side of said electric motor, with a suction hole opened to other side surface of said silencer box, and an outlet opened to a partition constituting said first air flow path;

wherein said first air flow path is shaped so as to reach said outlet of said first air flow path via an opposite position from said outlet of said first blower.

8. A ventilating device according to claim 7, wherein casings of said first blower and said second blower are respectively fixed to end brackets of said electric motor, said casing of said first blower and said casing of said second blower are connected by a rigid body; and said rigid both exists continuously so as to constitute an air flow path between an outer surface of said electric motor.

9. A ventilating device, comprising:

a silencer box including an opening on one of the surfaces;

a lid being fixed to said box for closing said opening;

a structure comprising said box and said lid constituting at least first air flow path to its interior, the first air flow path having opposed upper and lower surfaces, and a second air flow path;

said structure including an inlet and an outlet for said first air flow path, and including an inlet and an outlet for said second air flow path;

an electric motor of both shaft type being fixed to the lower surface of said first air flow path inside said first air flow path, with a rotary shaft thereof provided in a horizontal direction;

a first blower for air supply or exhaust being installed to one end side of said electric motor, with a suction hole opened to one side surface of said silencer box, and an outlet opened inside said first air flow path; and a second blower for exhaust or air supply being installed to the other end side of said electric motor, with a suction hole opened to other side surface of said silencer box, and an outlet opened to a partition constituting said first air flow path;

wherein said structure constitutes a second air flow path and a third air flow path;

said suction hole of said second blower is opened to said second air flow path; and said outlet of said second blower is opened to said third air flow path.

10. A ventilating device according to claim 9, wherein a hole connecting to said third air flow path is provided to said lid.

11. A ventilating device, comprising:

a silencer box including an opening on one of the surfaces;

a lid being fixed to said box for closing said opening;

a structure comprising said box and said lid constituting at least first air flow path to its interior, the first air flow path having opposed upper and lower surfaces, and a second air flow path;

said structure including an inlet and an outlet for said first air flow path, and including an inlet and an outlet for said second air flow path;

an electric motor of both shaft type being fixed to the lower surface of said first air flow path inside said first air flow path, with a rotary shaft thereof provided in a horizontal direction;

a first blower for air supply or exhaust being installed to one end side of said electric motor, with a suction hole opened to one side surface of said silencer box, and an outlet opened inside said first air flow path; and a second blower for exhaust or air supply being installed to the other end side of said electric motor, with a suction hole opened to other side surface of said silencer box, and an outlet opened to a partition constituting said first air flow path;

wherein said outlet of said first blower and said outlet of said second blower are located towards identical radial direction of said rotary shaft.

12. A method of manufacturing a ventilating device, the method comprising:

preparing a silencer box capable of storing in the interior thereof an air flow path for air supply equipped with an inlet and an outlet for air, and an air flow path for exhaust equipped with an inlet and an outlet for air which are different from said former inlet and outlet, said silencer box having an opening at least at the upper surface thereof;

preparing an air blow device including an air supply blower mounted to one end of a rotary shaft of a double-blower-type electric motor and an exhaust blower mounted to the other end thereof, said air supply blower and said exhaust blower each comprising a casing having an inlet and an outlet for air and an impeller, respectively;

inserting said air blow device from said opening formed to the upper surface of said silencer box to said air flow path for exhaust, by relatively moving said silencer box and said air blow device in the vertical direction;

fixing said air blow device to said silencer box in a state where the rotary shaft of said air blow device is positioned in the horizontal direction;

covering said opening through which said air blow device is inserted with a lid; and thereby constituting said air flow path for air supply and said air flow path for exhaust, and forming as a result four openings for ventilation.

13. A method of manufacturing a ventilating device according to claim 12, wherein:

the outlet of said exhaust blower is positioned within said air flow path for exhaust.

14. A method for manufacturing a ventilating device according to claim 12, further comprising:

upon fixing said air blow device to said silencer box, positioning a suction opening of said air supply blower so that it comes into contact with a partition that separates said air flow path for air supply and said air flow path for exhaust; and upon fixing to said silencer box an exhaust duct connected to the outer surface of the side wall of said silencer box, connecting said exhaust duct to the suction opening of said exhaust blower.

15. A method for manufacturing a ventilating device, the method comprising:

preparing a silencer box capable of storing in the interior thereof an air flow path for air supply equipped with an inlet and an outlet for air, and an air flow path for exhaust equipped with an inlet and an outlet for air different from said former inlet and outlet, said silencer box having an opening at least at the lower surface thereof;

preparing an air blow device including an air supply blower mounted to one end of a rotary shaft of a double-blower-type electric motor and an exhaust blower mounted to the other end thereof, and further mounting said air blow device on a lid for covering said opening formed to the lower surface of said silencer box, said air supply blower and said exhaust blower each comprising a casing having an inlet and an outlet for air and an impeller, respectively;

inserting said air blow device from said opening formed to the lower surface of said silencer box to said air flow path for exhaust, by relatively moving said silencer box and said air blow device in the vertical direction;

fixing said lid to said silencer box; and thereby constituting said air flow path for air supply and said air flow path for exhaust, and forming as a result four openings for ventilation.

16. A ventilating device, comprising:

a silencer box having an opening formed to one surface thereof;

a lid being fixed to said silencer box for closing said opening;

a structure comprising said silencer box and said lid further having in the interior thereof an air flow path for air supply, the air flow path for air supply having opposed upper and lower surfaces, and an air flow path for exhaust;

said structure including an inlet and an outlet for said air flow path for air supply, and further including an inlet and an outlet for said air flow path for exhaust;

a double-blower-type electric motor being fixed to the lower surface of said air flow path for exhaust within said air flow path for exhaust, with the rotary shaft thereof arranged in the horizontal direction;

an exhaust blower mounted to one end of said electric motor and positioned within said air flow path for exhaust, having a suction opening connected to said inlet of said air flow path for exhaust and an outlet opened into said air flow path for exhaust; and an air supply blower mounted to the other end of said electric motor and positioned within said air flow path for exhaust, having a suction opening connected to said inlet of said air flow path for air supply and an outlet opened into said air flow path for air supply.

17. A ventilating device according to claim 16, wherein:

said lid is mounted to an upper surface of said silencer box; and said electric motor is mounted to a bottom surface of said silencer box.

18. A ventilating device according to claim 16, wherein:

said lid is mounted to a lower surface of said silencer box; and said electric motor is mounted to said lid.

19. A ventilating device according to claim 16, wherein:

said air blow device including said electric motor, said exhaust blower and said air supply blower is mounted movably along a substantially horizontal rail.

20. A ventilating device according to claim 16, wherein:

casings of said air supply blower and said exhaust blower are respectively fixed to end brackets of said electric motor;

said casing of the air supply blower and said casing of the exhaust blower are connected by a rigid body; and a lower portion of each casing is respectively fixed to a pedestal mounting said electric motor.

21. A ventilating device according to claim 16, wherein:

said air flow path for exhaust reaches said outlet of said air flow path for exhaust via a position opposite from said exhaust blower outlet.

22. A ventilating device according to claim 21, wherein:

a casing of the exhaust blower and a casing of the air supply blower are connected by a rigid body; and said rigid body forms an arc-shape along the outer surface of said electric motor so as to constitute an air flow path between said outer surface of said electric motor.

23. A ventilating device according to claim 16, wherein:

said air flow path for air supply comprises a first air flow path and a second air flow path;

said suction opening of said air supply blower is opened to said first air flow path; and said outlet of said air supply blower is opened to said second air flow path.

24. A ventilating device according to claim 23, wherein:

an opening connected to said second air flow path is provided to said lid.

25. A ventilating device according to claim 16, wherein:

said outlet of said exhaust blower and said outlet of said air supply blower are arranged so as to face the same lateral direction of said rotary shaft.

26. A ventilating device according to claim 16, wherein:

said outlet of said air supply blower is connected to a partition that divides said air flow path for exhaust and said air flow path for air supply; and each inlet of said exhaust blower and said air supply blower are respectively connected to a member constituting said air flow path for exhaust and a member constituting said air flow path for air supply.

27. A ventilating device according to claim 26, wherein:

said outlet of said air supply blower and said partition are connected via a cushioning material; and said outlet of said air supply blower is positioned facing partially downward and said partition is positioned facing partially upward.

28. A ventilating device according to claim 16, wherein:

an exhaust duct is fixed from the outside to the side surface of said silencer box; and said suction opening of said exhaust blower is connected via a cushioning material to a member forming said exhaust duct.

29. A car comprising:

a car body;

a silencer box having an opening formed to one surface thereof;

a lid being fixed to said silencer box for closing said opening;

a structure comprising said silencer box and said lid further having in the interior thereof an air flow path for air supply and an air flow path for exhaust;

said structure including an inlet and an outlet for said air flow path for air supply, and further including an inlet and an outlet for said air flow path for exhaust;

a double-blower-type electric motor being fixed to the lower surface of said air flow path for exhaust within said air flow path for exhaust, with the rotary shaft thereof arranged in the horizontal direction;

an exhaust blower mounted to one end of said electric motor and positioned within said air flow path for exhaust, having a suction opening connected to said inlet of said air flow path for exhaust and an outlet opened into said air flow path for exhaust; and an air supply blower mounted to the other end of said electric motor and positioned within said air flow path for exhaust, having a suction opening connected to said inlet of said air flow path for air supply and an outlet opened into said air flow path for air supply;

wherein said inlet of said air flow path for exhaust is connected to said car body; and said inlet and said outlet of said air flow path for air supply is also connected to said car body.

30. A method of manufacturing a ventilating device, the method comprising:

preparing a silencer box capable of storing in the interior thereof an air flow path for air supply equipped with an inlet and an outlet for air, and an air flow path for exhaust equipped with an inlet and an outlet for air which are different from said former inlet and outlet, said silencer box having an opening at least at one side surface thereof;

preparing an air blow device including an air supply blower mounted to one end of a rotary shaft of a double-blower-type electric motor and an exhaust blower mounted to the other end thereof, said air supply blower and said exhaust blower each comprising a casing having an inlet and an outlet for air and an impeller, respectively;

inserting said air blow device to said air flow path for exhaust, by relatively moving said silencer box and said air blow device in the horizontal direction;

fixing said air blow device to said silencer box in a state where the rotary shaft of said air blow device is positioned in the horizontal direction;

covering said opening at said side surface with a lid; and thereby constituting said air flow path for air supply and said air flow path for exhaust, and forming as a result four openings for ventilation.

31. A method of manufacturing a ventilating device according to claim 30, wherein:

said movement in the horizontal direction is performed in the axial direction of said air blow device.

* * * * *